United States Patent [19]

Tadokoro

[11] 3,946,940

[45] Mar. 30, 1976

[54] CENTRIFUGAL BASKET

[75] Inventor: Takaya Tadokoro, Chiba, Japan

[73] Assignee: Tsukishima Kikai Co., Ltd., Tokyo, Japan

[22] Filed: Nov. 22, 1974

[21] Appl. No.: 526,260

Related U.S. Application Data

[63] Continuation of Ser. No. 367,338, June 5, 1973, abandoned.

[30] Foreign Application Priority Data

June 20, 1972 Japan ..... 47-61701

[52] U.S. Cl. ..... 233/2; 233/27; 233/46

[51] Int. Cl.[2] ..... B04B 15/06

[58] Field of Search ..... 233/1 R, 1 B, 27, 28, 46, 233/47 R, 2, 17, 33

[56] References Cited

UNITED STATES PATENTS

| | | | |
|---|---|---|---|
| 487,943 | 12/1892 | Beimling | 233/33 |
| 2,854,143 | 9/1958 | Novak | 233/17 X |

FOREIGN PATENTS OR APPLICATIONS

| | | | |
|---|---|---|---|
| 145,825 | 11/1903 | Germany | 233/47 R |
| 1,163,737 | 2/1964 | Germany | 233/27 |
| 1,209,957 | 1/1966 | Germany | 233/27 |

*Primary Examiner*—George H. Krizmanich
*Attorney, Agent, or Firm*—Edwin E. Greigg

[57] ABSTRACT

A basket for a centrifugal separator which has a rotatable shell having at least one flange formed at one end thereof for containing liquid, an exchangeable flat ring having a number of holes radially formed therethrough with respect to the center axis of said shell and removably mounted to the flange of said shell for discharging liquid contained in said shell, and a plurality of circular cover for coating one end surface of said exchangeable ring. Since the basket is thus constructed, it is adapted for high speed rotation.

9 Claims, 7 Drawing Figures

FIG. 5
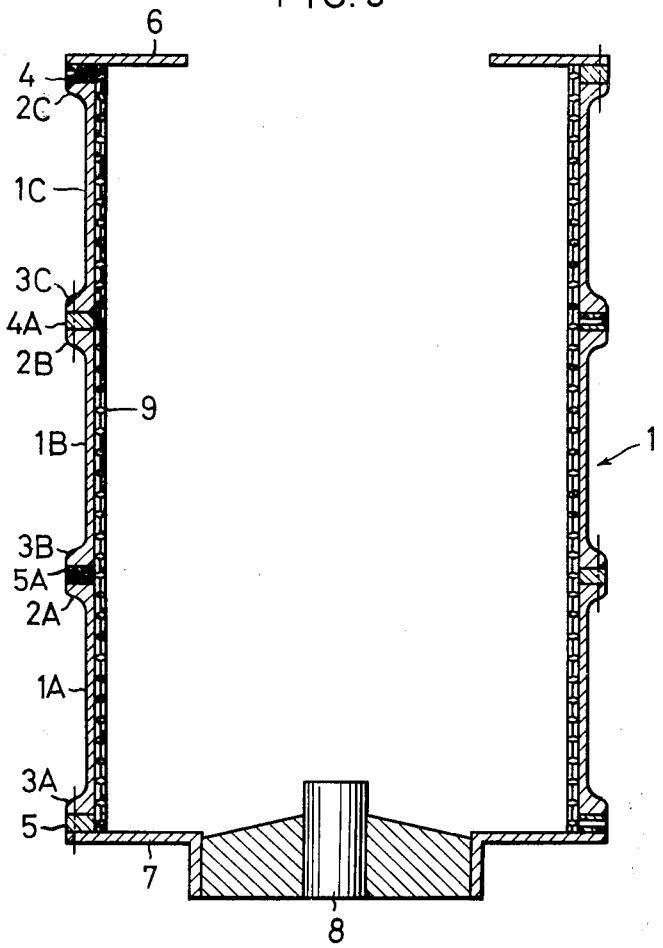
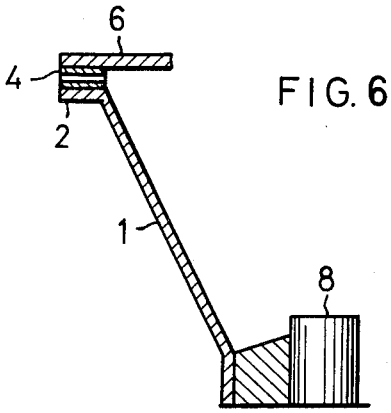
FIG. 6

CENTRIFUGAL BASKET

This is a continuation of application Ser. No. 367,338, filed June 5, 1973, now abandoned.

This invention relates to centrifugal separators, and more particularly to a basket for centrifugal separators.

The separating function of a centrifugal separator is enhanced by increasing the rotating speed of the basket for the centrifugal separator. However, it is difficult to increase the basket speed in the conventional centrifugal separator higher than its present rotating speed for the reasons that will be described hereinafter.

Since a number of holes for discharging liquid are formed directly in the wall of the conventional centrifugal basket in which wall a circumferential tensile stress is acting, a large stress concentration is caused in the vicinity of the holes when the shell plate rotates at a high speed. Therefore, the maximum allowable speed of the conventional centrifugal separator basket with such holes, depends upon the magnitude of the stress concentration in the vicinity of the holes.

In addition to the aforementioned disadvantage in structure of the conventional basket for the centrifugal separator, the basket has another disadvantage in manufacturing as will be hereinafter described.

Since the conventional basket for the centrifugal separator is integrally constructed as a whole, the whole basket must be replaced even if only a part of the basket is worn. However, as the basket is worn in a limited portion such as, for example, in the vicinity of the holes for discharging liquid, such overall replacement of the basket is not economical.

In addition, since the conventional basket for the centrifugal separator is integrally constructed as a whole, when a larger size of basket must be manufactured, it is necessary to design anew the entire device from the beginning. This would clearly result in much increased cost of the centrifugal separator.

One object of the present invention is, therefore, to provide a basket for a centrifugal separator which eliminates the aforementioned disadvantages of the conventional basket for a centrifugal separator and which is well adapted for high speed rotation.

Another object of the present invention is to provide a basket for a centrifugal separator which may be manufactured less expensively and which will be much more durable.

In order to perform the aforementioned objects of the present invention, the shell itself of the centrifugal separator of the invention is not perforated at all, but there are provided a plurality of exchangeable flat rings which have a number of holes radially formed therethrough with respect to the center axis of the shell and which are removably mounted to the flange formed at least at one end of the shell. Thus, there exists no stress concentration at the rotary shell of the centrifugal separator, and accordingly the shell may be accelerated faster than the conventional speed thereof. In addition, a flange is provided at the end of the shell of the centrifugal separator, at which end the stress concentration tends to be produced, and, thus it is more durable than the conventional basket. In addition, since the drainage openings of the basket — which are subjected to wear — are formed of exchangeable rings that are separable from the basket of this invention, even if the drainage openings of these rings wear, only they need be replaced with new ones, and it is not necessary to replace the entire basket of the centrifugal separator. Further, since the drainage openings where stress concentration normally tends to occur are provided only at the exchangeable rings, there is obtained a basket of a centrifugal separator which is adapted for high speed rotation.

In addition, in order to provide a larger size basket for a centrifugal separator, a plurality of baskets of the aforementioned type thus are axially superimposed and maintained in spaced relation by flat rings disposed therebetween. Therefore, even larger sizes of baskets for use with the centrifugal separator may be easily and quickly attained by a simple assembly operation.

These and other objects, features and advantages of the present invention will become more fully apparent from the following description given in conjunction with the accompanying drawings, in which:

FIG. 5 is a longitudinal sectional view of still another embodiment of the basket of this invention; and FIG. 6 is a partial sectional view of still another embodiment of the basket of this invention.

Figure 1:
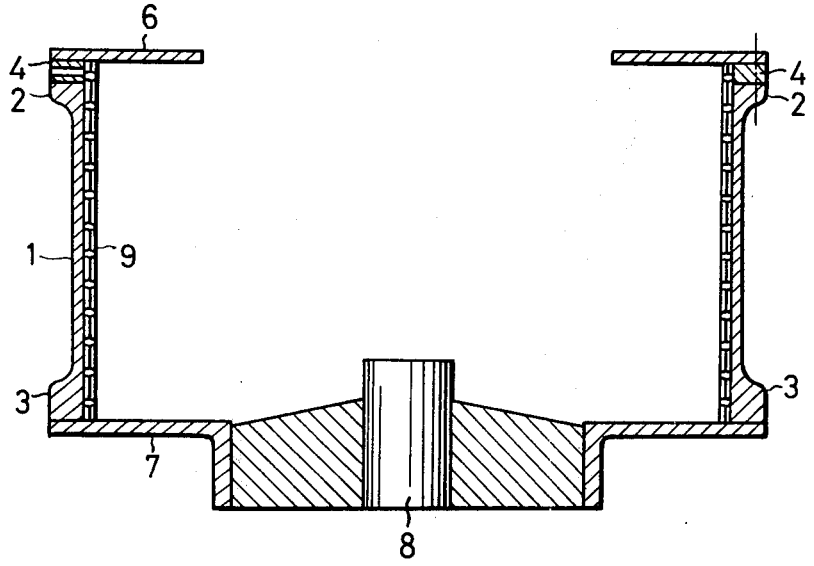
FIG. 1 is a longitudinal cross-sectional view of one embodiment of the basket for a centrifugal separator constructed in accordance with the present invention.

Turning now to the drawings, 1 represents a rotatable cylindrical imperforate shell formed with flanges 2 and 3 at opposite ends thereof, with the shell 1 being secured through exchangeable flat ring 4 either to an upper circular cover 6 (or lower circular cover 7) (see FIG. 2) and fastened thereto by suitable means such as bolting. As is well shown in FIGS. 1 and 2, the lower cover 7 includes a collar **7*a* that is arranged to be sealingly affixed to drive shaft 8 by the means shown at 7*b*. A filtering medium 9 is internally provided on the inner peripheral surface of the rotatable shell 1 for filtering fluid material contained in the rotatable shell 1**.

Figure 2:
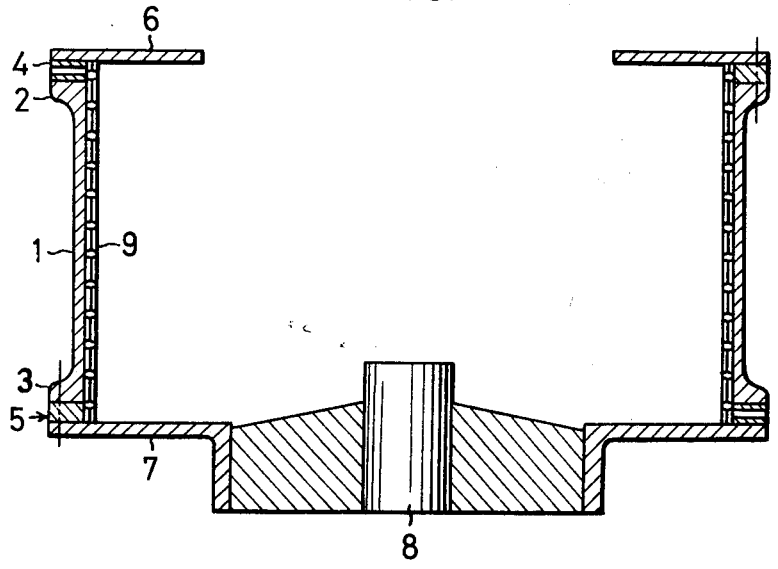
FIG. 2 is a longitudinal cross-sectional view of another embodiment of the basket for a centrifugal separator constructed according to the present invention.

Referring now to FIG. 2, there is shown another embodiment of the basket which has at least two exchangeable flat rings arranged to the upper and lower covers for the centrifugal separator of this invention, and in which the corresponding parts and components are compatible with those of the first embodiment shown in FIG. 1. The rotatable imperforate cylindrical shell 1 of this embodiment is also formed with flanges 2 and 3 at opposite ends thereof and additionally includes an exchangeable flat ring which is positioned between the bottom cover 7 and the flange 3 and is drivingly associated with the shaft 8 as explained earlier herein.

Figure 3:
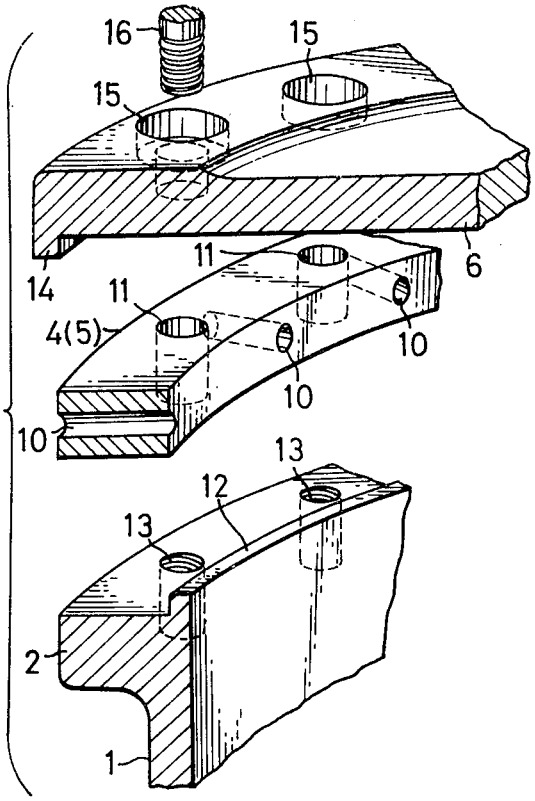
FIG. 3 is an enlarged and exploded perspective view of one corner portion of the basket showing the ring and cover construction of the invention.
Figure 4A:
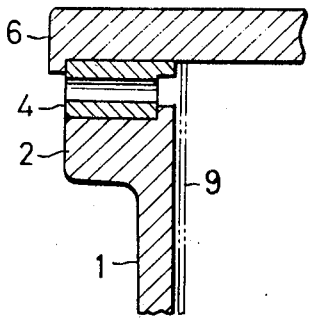
FIGS. 4A and 4B are partially enlarged longitudinal views of the relation in engagement of the parts shown in FIG. 3.
Figure 4B:
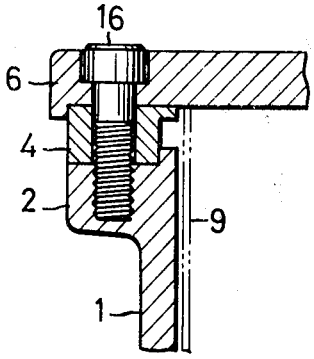

As shown best in the exploded partial view of the top of a shell in FIG. 3, the exchangeable flat ring 4 has a number of holes 10 formed radially therethrough with respect to the center axis of the rotatable shell 1 for centrifugally discharging the liquid contained in the shell 1 during rotation, said ring also including a series of holes 11 which are longitudinally formed intermediate the respective holes 10 for assembly of the cover 6 to the shell 1 by bolts 16 as will be described hereinafter in greater detail.

The diameter of the inner periphery of the exchangeable flat rings 4 and 5 is substantially the same as the outer diameter of the inner rims 12 projected from the end surface of the flanges 2 and 3, respectively, of the rotatable shell 1 with the result that the exchangeable rings 4 and 5 are prevented from radially inward movement by reason of the restriction afforded by the inner rims 12 provided at the top and bottom of shell 1.

A plurality of threaded apertures 13 are formed in the flanges 2 and 3 of the rotatable shell 1 and are arranged to accommodate the perforations 11 of the exchangeable rings 4 and 5 for fixing the exchangeable flat rings 4 and 5 between the upper cover 6 and the rotatable shell 1 as will be hereinafter described in greater detail.

The circular covers 6 and 7 are of larger diameter than the outer diameters of the flanges 2 and 3 of the rotatable shell 1, and include offstanding rim portions 14 which project axially of the rotatable shell 1. Since the upper and lower covers 6 and 7 are generally of the same in structure except for the seal and drive shaft described earlier only the upper circular cover 6 is shown in the drawing in detail.

Since the inner diameter of the outer rim 14 projected from the upper cover 6 is substantially the same as the outer diameter of the exchangeable flat rings 4 and 5, when the circular cover 6 is put on the exchangeable ring 4, the ring 4 is prevented from radially outward movement by means of the outer rims 14 of the upper cover 6.

The upper cover 6 includes a series of undercut portions which are adapted to accommodate the heads 16 of bolts 16*a* when the cover is affixed to the shell 1.

It is believed that it will be understood from the foregoing description that since the basket for the centrigugal separator is thus constructed, it is adapted for high speed rotation and may be less expensively manufactured.

Referring now to FIG. 5, there is shown still another embodiment of the basket for the centrifugal separator of this invention, in which the centrifuge basket 1 of a larger type is constructed of three rotatable shells 1A, 1B and 1C each of which has the same length and are superimposed longitudinally of the center axis thereof. The respective rotatable shells 1A, 1B and 1C have flanges 2A and 3A, 2B and 3B, and 2C and 3C, respectively at both ends thereof similarly to that shown in FIG. 2, and exchangeable flat rings 4A and 5A, 4B and 5B, and 4C and 5C similarly formed to those 4 and 5 shown in FIG. 3 are inserted between the respective flanges of the lower cover 7, the respective rotatable shells 1A, 1B and 1C, and the upper cover 6. Thus, radially perforated holes 10 for discharging liquid contained in the shell 1 are provided at the respective exchangeable flat rings 4A and 5A, 4B and 5B, and 4C and 5C of the rotatable shell 1. Therefore, the number of the holes 10 for discharging the liquid contained in the shell 1 are increased in proportion to the size of the basket for the centrifugal separator, and the number of the shells may be varied simply depending upon the necessity.

It will be understood that since the basket for the centrifugal separator of this invention is thus constructed, it may be simply enlarged in capacity.

Reference is now made to FIG. 6, which shows still another embodiment of the basket for the centrifugal separator of the invention.

The rotatable shell 1 is conically formed with its wall diverging outwardly, but otherwise the other construction is the same as that shown in FIGS. 1 and 2.

While several modification of the basket have been shown, it should be reorganized that other forms and variations of the invention will become clearly apparent to those skilled in the art. Therefore, while the present forms have been shown and described for the purpose of clearly and concisely illustrating the principles of the invention, it is not intended to limit or narrow the invention beyond the broad concept set forth in the appended claims.

What is claimed is:

1. A centrifugal separator basket construction comprising a rotatable imperforate shell having a center axis, first and second open ends, opposite end walls, including at least one offstanding flange portion formed on at least one of said end walls thereof; at least one exchangeable perforate ring means having a series of open, fluid drainage openings of fixed open cross section disposed therein radially with respect to said center axis of said shell; means fixing said ring means to at least one of said end walls; first cover means positioned fixedly to said ring means for closing said first open end; second cover means positioned for closing said second open end; means for securing said second cover means to said shell; and drive means coupled to said second cover means for rotating said shell about said center axis.

2. A centrifugal separator basket construction as claimed in claim 1, in which a filtering means is positioned in the rotatable imperforate shell.

3. A centrifugal separator basket construction as claimed in claim 1, in which the shell has at least one conical wall portion, the convergent terminus thereof being associated with said drive means.

4. A centrifugal separator basket construction as claimed in claim 1, wherein said second cover means includes at least one conical portion, the convergent terminus thereof being connected to said drive means.

5. A centrifugal separator basket construction as claimed in claim 1, in which said flange portion includes an annular offstanding inner rim means projected from an end surface thereof, the outer diameter of said rim means being substantially equal to the inner diameter of said ring means.

6. A centrifugal separator basket construction as claimed in claim 1, in which at least said first cover means includes an outer rim means projecting from a perimetrical portion thereof, the inner diameter of said outer rim means being substantially equal to the outer diameter of said ring means.

7. A centrifugal separator basket construction as claimed in claim 1, in which both of said end walls of the shell includes an offstanding flange portion, one of them being said at least one flange portion.

8. A centrifugal separator basket construction as claimed in claim 7, in which a plurality of said shells are superimposed and maintained in assembled spaced relation by said exchangeable perforate ring means and said means for securing means, said perforate ring means including a respective perforate ring between each said shell.

9. A centrifugal separator basket construction as claimed in claim 1, in which said exchangeable perforate ring means have a series of said openings therein which are disposed alternatively at right angles to one another.

* * * * *